US010736800B2

(12) United States Patent
Norlin et al.

(10) Patent No.: US 10,736,800 B2
(45) Date of Patent: Aug. 11, 2020

(54) WHEELCHAIR BRAKE ASSEMBLY AND A WHEELCHAIR COMPRISING THE WHEELCHAIR BRAKE ASSEMBLY

(71) Applicant: Autoadapt AB, Stenkullen (SE)

(72) Inventors: Jan Norlin, Stenkullen (SE); Pierre Durå, Dalsjöfors (SE)

(73) Assignee: Braunability Europe AB, Stenkullen (SE)

( * ) Notice: Subject to any disclaimer, the term of this patent is extended or adjusted under 35 U.S.C. 154(b) by 72 days.

(21) Appl. No.: 16/304,464

(22) PCT Filed: May 24, 2017

(86) PCT No.: PCT/EP2017/062529
§ 371 (c)(1),
(2) Date: Nov. 26, 2018

(87) PCT Pub. No.: WO2017/202905
PCT Pub. Date: Nov. 30, 2017

(65) Prior Publication Data

US 2019/0290515 A1 Sep. 26, 2019

(30) Foreign Application Priority Data

May 27, 2016 (SE) ..... 1650738

(51) Int. Cl.
*A61G 5/10* (2006.01)
*A61G 5/08* (2006.01)

(52) U.S. Cl.
CPC ..... *A61G 5/1037* (2013.01); *A61G 5/1024* (2013.01); *A61G 5/0875* (2016.11); *A61G 5/101* (2013.01); *A61G 5/1008* (2013.01)

(58) Field of Classification Search
CPC ..... A61G 5/021; A61G 5/041; A61G 5/10; A61G 5/12; A61G 5/125; A61G 5/128; A61G 5/1024; A61G 5/1037
(Continued)

(56) References Cited

U.S. PATENT DOCUMENTS 4,480,720 A * 11/1984 Shimano ..... B62L 3/08 188/2 D
5,346,039 A * 9/1994 Pfisterer ..... A61G 5/1018 188/2 F
(Continued)

FOREIGN PATENT DOCUMENTS

DE 19712453 A1 10/1998
GB 1442805 A 7/1976
(Continued)

OTHER PUBLICATIONS

International Search Report including Written Opinion of PCT/EP2017/062529 dated Aug. 3, 2017.

*Primary Examiner* — Christopher P Schwartz
(74) *Attorney, Agent, or Firm* — Taft Stettinius & Hollister LLP; Stephen F. Rost

(57) ABSTRACT

The present invention relates to a wheelchair brake assembly comprising a seat brake system and a wheel frame brake system. The seat brake system and the wheel frame brake system are separable from each other. The seat brake system comprises a caregiver brake lever and an actuating member, the caregiver brake lever being coupled to the actuating member. The wheel frame brake system comprises a brake transmission assembly, a first brake mechanism and a second brake mechanism which are adapted to be provided on a first wheel and a second wheel of the wheelchair respectively. The brake transmission assembly is coupled to the first brake mechanism and the second brake mechanism. The brake transmission assembly comprises an actuating lever having
(Continued)

a first free end and a second end. The second end is coupled to the first brake mechanism and the second brake mechanism. The actuating lever is rotatable about an axis perpendicular to the longitudinal extension of the actuating lever and located between the first free end and the second end of the actuating lever, wherein the actuating member is adapted to operate on the first free end of the actuating lever to cause the actuating lever to rotate.

13 Claims, 6 Drawing Sheets

(58) Field of Classification Search
USPC .... 188/2 D, 2 F; 280/244, 249, 250.1, 304.1
See application file for complete search history.

(56) References Cited

U.S. PATENT DOCUMENTS 5,540,304 A * 7/1996 Hawkins ..... B60T 11/06 188/2 D
6,471,231 B1 * 10/2002 Hargroder ..... A61G 5/1024 188/2 F
8,261,887 B2 * 9/2012 Tseng ..... B60T 11/046 188/24.22
9,027,948 B2 * 5/2015 Ooyama ..... A61G 5/1018 280/250.1

FOREIGN PATENT DOCUMENTS

JP 2003265536 A 9/2003
JP 2005034326 A 2/2005
KR 20100112382 A 10/2010

* cited by examiner

WHEELCHAIR BRAKE ASSEMBLY AND A WHEELCHAIR COMPRISING THE WHEELCHAIR BRAKE ASSEMBLY

CROSS-REFERENCE TO RELATED APPLICATIONS

This application is a national phase entry under 35 U.S.C. § 371 of International Application No. PCT/EP2017/062529 filed on May 24, 2017, which claims priority to Swedish Patent Application No. 1650738-6 filed on May 27, 2016, the disclosures of which are incorporated herein by reference.

TECHNICAL FIELD

The present invention relates to a wheelchair brake assembly comprising a seat brake system and a wheel frame brake system and wherein the two systems are separable from each other. It further relates to a wheelchair comprising the wheelchair brake assembly.

BACKGROUND OF THE INVENTION

Vehicles can have seats, seat assemblies, or seat structures (hereinafter referred to as seating systems) adapted to address physical immobility or other issues with drivers and passengers. Commonly, such a seating system is adapted to move the seat between a drive position in which the seat faces forward inside the vehicle and an access position in which the seat has rotated and is facing out of the vehicle door opening.

For the immobilized person for whom a seating system of this kind is intended the wheelchair is the natural choice of transportation to and from the vehicle. In further making it easier to transfer the immobilized person from the wheelchair to the vehicle seat it is known to have a wheelchair, in which the seat can be separated from wheel frame and transferred to the seating system inside the vehicle. Thus the immobilized person can remain seated on the same seat during the entire transport, whether the seat makes up a wheelchair or a seat of a seating system in a vehicle.

A combined wheelchair and vehicle seat provides challenges in particular when it comes to the design of the brake system for the wheelchair. For example, the published Japanese patent application no. JP 2003 265536 A discloses a wheelchair wherein the seat can be separated from the wheel frame and a brake system for such a wheelchair. However, previous systems are limited in several ways. With a caregiver responsible for pushing the wheelchair with the immobilized person seated, a wheelchair brake system has to be provided that enables the caregiver to brake efficiently and safely. The brake system has to provide for an effective, smooth braking. At the same time, as the seat is separated from the wheel frame, the brake system will have to be separable into a seat system, and a wheel frame system. Thus, an efficient transmission mechanism of the brake force between the two systems is desirable. A further challenge is that the features of the wheelchair brake assembly may have to be adapted not to interfere with the crashworthiness of the seat when the seat is in the drive position inside the vehicle. Hence, there is a desire to address the above mentioned challenges and provide an improved wheelchair brake assembly that enables an easy attachment/detachment of the seat to and from a wheel frame, while at the same time enabling an efficient transmission of the brake force and a smooth braking of the wheelchair.

SUMMARY OF THE INVENTION

Viewed from a first perspective, the present teachings can provide an improved wheelchair brake assembly for a wheelchair with a seat that can be separated from the wheel frame and transferred to a seating system of a vehicle, to achieve an easy, efficient and smooth braking action for the wheelchair.

Viewed from another perspective the present teachings can provide a wheelchair with a detachable seat that has a wheelchair brake assembly which provides for an easy, efficient and smooth braking of the wheelchair.

Further embodiments are set forth in the appended dependent claims, in the following description and in the drawings.

The wheelchair brake assembly described below eliminates or at least alleviate the short-comings of the prior art as it provides a wheelchair brake assembly for a wheelchair wherein the seat can be separated from the wheel frame. The wheelchair brake assembly comprises a seat brake system and a wheel frame brake system. The seat brake system and the wheel frame brake system are separable from each other. The seat brake system comprises a caregiver brake lever and an actuating member, wherein the caregiver brake lever is coupled to the actuating member. The wheel frame brake system comprises a brake transmission assembly and a first brake mechanism and a second brake mechanism, which are adapted to be provided on a first wheel and a second wheel of the wheelchair respectively. The brake transmission assembly is coupled to the first brake mechanism and the second brake mechanism. The brake transmission assembly comprises an actuating lever having a first free end and a second end, wherein the second end is coupled to the first brake mechanism and the second brake mechanism. The actuating lever is rotatable about an axis perpendicular to the longitudinal extension of the actuating lever and located between the first free end and the second end of the actuating lever. The axis may be located in a mid-portion of the actuating lever, such as halfway or substantially halfway between the first free end and the second end. The actuating member of the seat brake system is adapted to operate on the first free end of the actuating lever to cause the second end of the actuating lever to rotate.

By having a wheelchair brake assembly of this kind several advantageous effects may be achieved. The wheelchair brake assembly as disclosed herein provides a simple, yet robust transmission mechanism of the braking action. A positive effect is the easiness by which the two systems can be attached to and detached from each other, wherein at attachment of the seat to the wheel frame, the actuating member is brought within operative range of the first free end of the actuating member.

For a wheelchair provided with a wheelchair brake assembly as disclosed herein the caregiver brake lever may be arranged together with a handle of the wheelchair. The caregiver brake lever and handle may further be adapted to be retracted in a back pocket comprised in the seat of the wheelchair.

This has the positive effect that when the seat is separated from the wheel frame and transferred to a seating system inside the vehicle, the caregiver brake lever and handles may be retracted into the seat back and covered with a protective flap and thus will not constitute a potential harmful threat to a rear seat passenger for example in the event of an accident.

The wheelchair brake assembly as disclosed herein may be adapted to comprise a second seat brake system, thus providing the wheelchair with two caregiver brake levers, and wherein the wheelchair brake assembly may further be adapted to comprise a second brake transmission assembly.

As disclosed herein, the brake transmission assembly may further comprise a parking brake mechanism. The parking brake mechanism has an idle position and a brake position. The parking brake mechanism is in brake position adapted to operate on the second end of the actuating lever to cause the same to rotate. Simultaneously, the first free end of the actuating lever is decoupled from being operative by the actuating member.

Thus, an advantage of comprising the parking brake mechanism as disclosed herein is that the same brake mechanisms is used for braking via the seat brake system and for activating the parking brake.

The parking brake mechanism and the actuating member of the seat brake system as disclosed herein are both adapted to operate on the actuating lever to cause the second end of the same to rotate, and thereby activating the brake mechanisms.

As disclosed herein, the parking brake mechanism may comprise a rotatable brake lever and a parking brake actuating member. The brake lever has a first end portion and a second end portion. The parking brake actuating member has a first end portion and a second end portion. The second end portion of the parking brake actuating member is adapted to operate on the second end of the actuating lever by means of a rotation of the brake lever, wherein the parking brake actuating member is connected directly or indirectly to the brake lever. For example, the parking brake actuating member may be connected via a linkage system to the brake lever.

As disclosed herein, the parking brake mechanism may further comprise a linkage arm. The parking brake actuating member has a first leg comprising the first end portion of the parking brake actuating member and a second leg comprising the second end portion of the parking brake actuating member. The first leg of the parking brake actuating member and the second leg of the parking brake actuating member are substantially perpendicular to each other. The parking brake actuating member is rotatable around an axis located at its first end portion. The linkage arm is at one end rotatably connected to the second end portion of the brake lever and at the opposite end rotatably connected to the parking brake actuating member such that rotating the first end portion of the brake lever causes the parking brake actuating member to rotate and thereby causing the second end portion of the parking brake actuating member to operate on the second end of the actuating lever to rotate the same.

The linkage arm of the parking brake mechanism as disclosed herein may be adapted to be substantially perpendicular to the first leg of the parking brake actuating member in idle position of the parking brake mechanism, and wherein the linkage arm is rotatable to form an angle of less than 90° in relation to the first leg of the parking brake actuating member in brake position of the parking brake mechanism.

The parking brake mechanism as disclosed herein may be provided with a locking recess which is adapted to retain the second end portion of the brake lever, in the brake position of the parking brake mechanism at the angle of less than 90° between the linkage arm and the first leg of the parking brake actuating member.

A positive effect of having a parking brake mechanism of a kind disclosed herein is that the parking brake mechanism automatically locks or retains itself in brake position. A further advantage is that the parking brake mechanism can be activated and deactivated using one hand only. The parking brake mechanism is activated by rotating the brake lever which causes the brake mechanisms provided on the wheels to activate. The brake lever is retained in that rotated position. The parking brake mechanism is released simply by force of hand reversing the rotation of the brake lever and bringing it back to its idle position.

The wheel frame brake assembly as disclosed herein may comprise a brake force distribution device. The brake force distribution device is couplable at one end to the second end of the actuating member and at the opposite end to the first brake mechanism and the second brake mechanism and is adapted to distribute a brake force transmitted from the brake transmission assembly to the first brake mechanism and the second brake mechanism.

By having a brake force distribution device of a kind disclosed herein several positive effects are achieved. It greatly simplifies and reduces the number of parts of the wheelchair brake assembly as disclosed herein, since it enables the use of a single seat brake system and single brake transmission assembly, and further provides an efficient smooth braking of the wheelchair.

As disclosed herein, the brake force distribution device may comprise a housing and a balance element, wherein the balance element is located within the housing. The balance element has a first end edge facing a first end of the housing and has a second end edge facing a second end of the housing. The balance element further has a first outer side edge and a second outer side edge both of which extends at least partly between the first end edge and the second end edge of the balance element. The first outer side edge and the second outer side edge have a convex shape, wherein at least a section of the first outer side edge and at least a section of the second outer side edge are adapted to abut a first inner wall and a second inner wall of the housing respectively, and wherein the balance element is rotatably displaceable in relation to the longitudinal axis of the housing.

As disclosed herein, the balance element has an extension along a symmetry axis of the balance element. The symmetry axis extends between the first end edge and the second end edge of the balance element. The first outer side edge and the second outer side edge of the balance element may have the shape of the minor arc of a circle with a radius, wherein the radius is larger than the maximum of the extension along the symmetry axis of the balance element, such as between 1.1 and 4 times larger, between 1.1 and 2.5 times larger, or between 1.1 and 2 times larger.

The balance element may be made in a polymeric material, such as a thermoplastic. An example of a thermoplastic material may be polyamide. Other useful materials may be composites of polymers and reinforcing materials, e.g. fibers or particles, for example polyamide comprising glass fibres. The balance element may also be made of a metallic material. An example of a metallic material may be zinc.

Using a polymeric material, such as polyamide for the balance element, provides a light-weight, yet tough and resistant balance element. Further it provides easy manufacturing and low manufacturing costs as thermoplastic polymers can be formed into a desired shape by production methods such as 3D-printing and injection moulding.

The first brake mechanism and the second brake mechanism of the wheelchair brake assembly as disclosed herein may comprise disc brakes.

By having disc brakes in the wheel brake assembly as disclosed herein several advantages are achieved. It is advantageous to use this type of brake since it provides an efficient brake force to be generated in response to a small stroke generated by some kind of braking actuating member. Thus, using disc brakes in the wheelchair brake assembly as disclosed herein contributes to the efficiency of the wheelchair brake assembly, and of the brake transmission assembly in particular. A further positive effect is that it provides for an effective safe braking of the wheelchair. Other types of brake mechanisms with similar characteristics as disc brakes may represent equally advantageous plausible brake mechanisms for a wheel brake assembly as disclosed herein.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components are not necessarily drawn to scale.

Figure 1A:
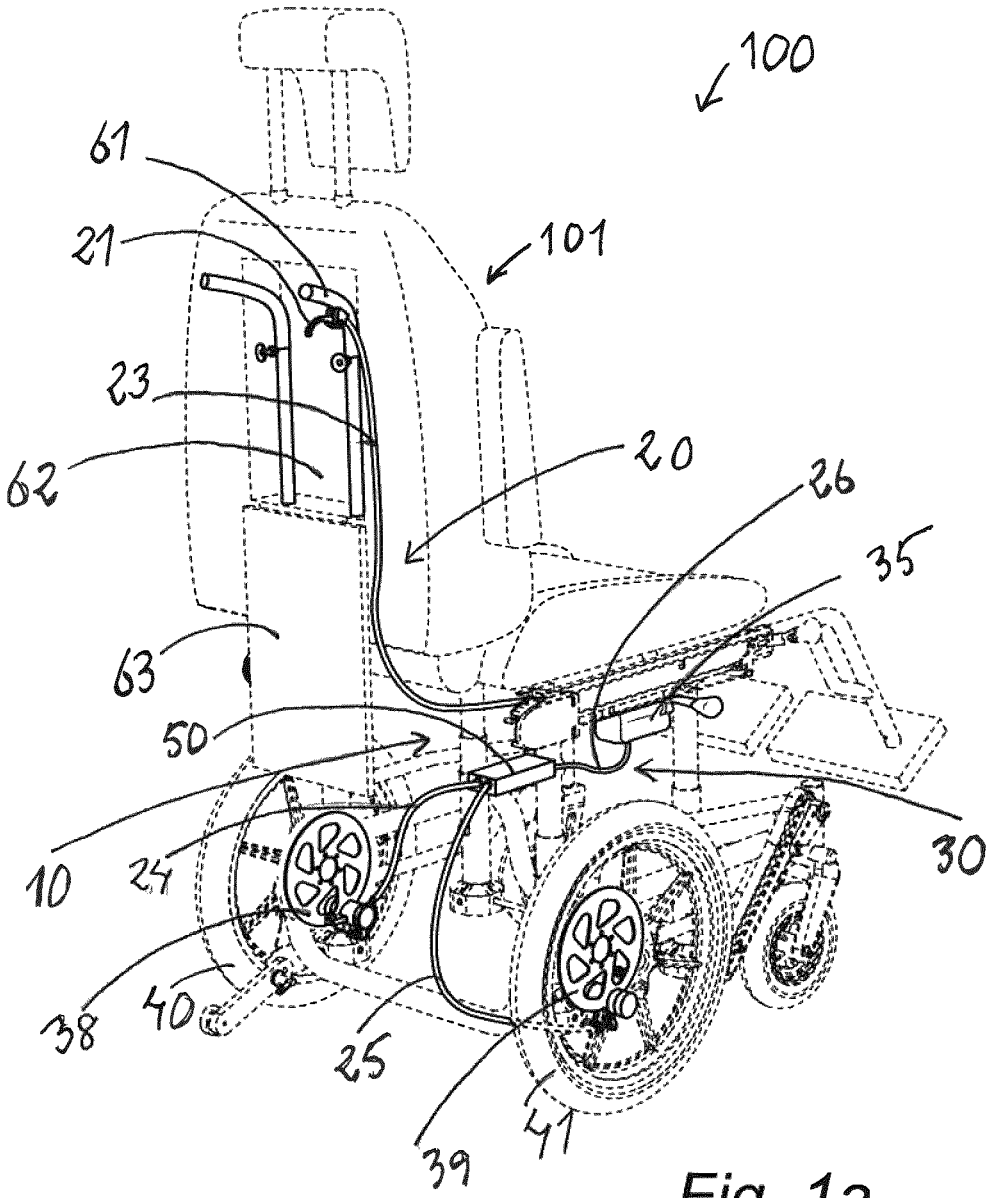
FIG. 1*a* shows a wheelchair comprising a wheelchair brake assembly as disclosed herein.
Figure 1B:
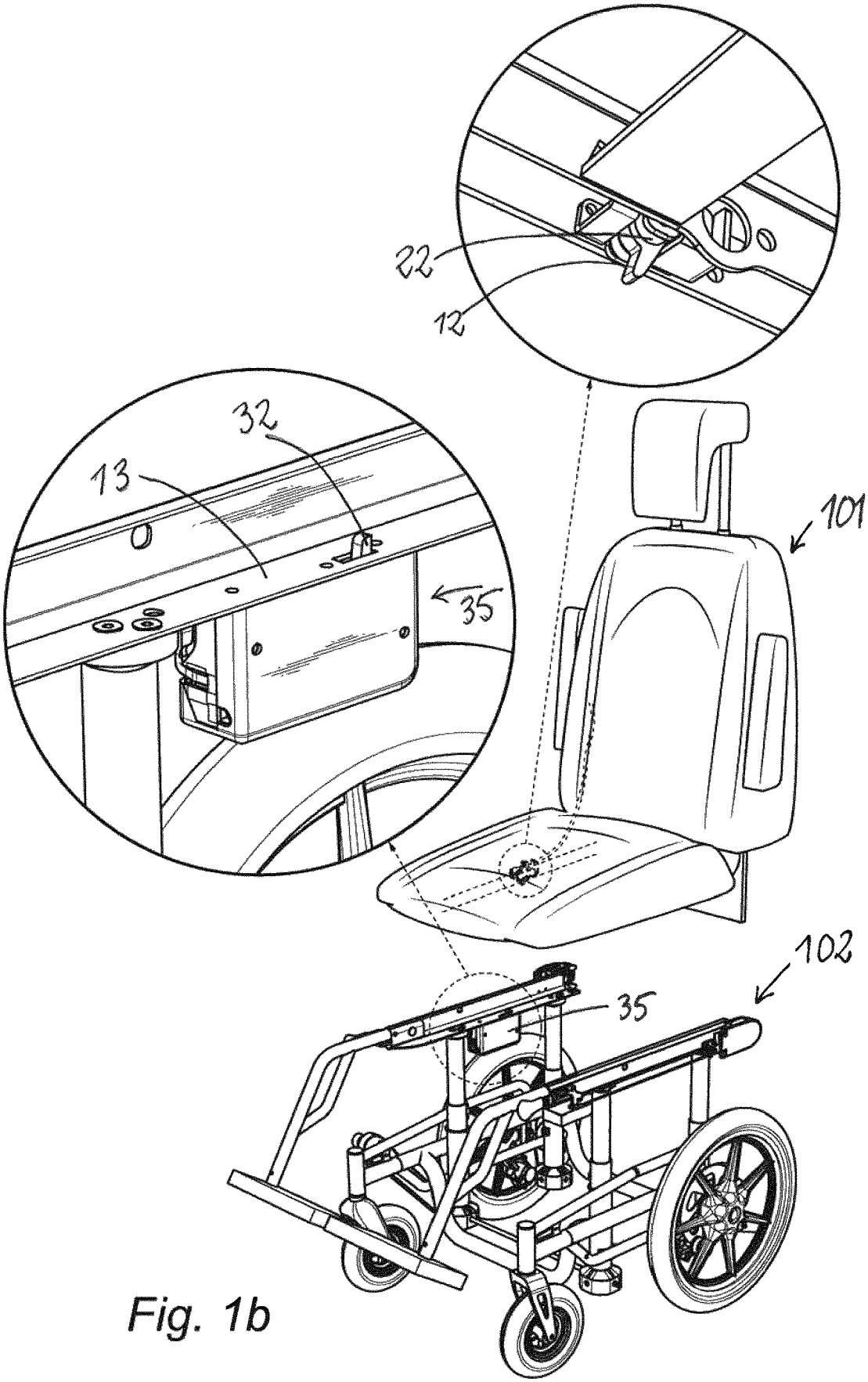
FIG. 1*b* shows the wheelchair with the seat separated and a seat brake system and a wheel frame system as disclosed herein in a separated state.

With reference to FIG. 1*a*, a wheelchair 100 is disclosed for which a wheelchair brake assembly 10 of a kind disclosed in the present disclosure may be advantageous. The wheelchair brake assembly 10 of the present disclosure is adapted for being provided on a wheelchair 100 with a detachable seat 101. FIG. 1*b* discloses the seat 101 of the wheelchair separated from the wheel frame 102. With reference to FIGS. 1*a* and 1*b*, a wheelchair brake assembly 10 as set out in the present disclosure is disclosed. The wheelchair brake assembly 10 comprises a seat brake system 20 and a wheel frame brake system 30. The seat brake system 20 and the wheel frame brake system 30 are separable from each other. The seat brake system 20 is adapted to be provided on the detachable seat 101 of the wheelchair 100.

The seat brake system 20 comprises a caregiver brake lever 21 and an actuating member 22, the caregiver brake lever 21 being coupled to the actuating member 22. The caregiver brake lever 21 may be arranged together with a handle 61 of the wheelchair. In FIGS. 1*a* and 1*b* a single caregiver brake lever 21 and actuating member 22 are depicted. However, the wheelchair brake assembly as disclosed herein may be adapted to comprise a second seat brake system, thus providing the wheelchair with two caregiver brake levers. The caregiver brake lever 21 is disclosed in FIGS. 1*a* and 1*b* as being arranged together with a handle 61 of the wheelchair. Further, the caregiver brake lever 21 and the handle 61 are disclosed as being arranged in a back pocket 62 comprised in the seat 101. The caregiver brake lever 21 and the handle 61 may be adapted to be retractable in the back pocket 62, and covered with a protective cover 63. Hence, when the seat is used in the seating system inside the vehicle the caregiver brake lever 21 and handle 61 may be retracted inside the back pocket 62 comprised in the seat 101 and secured underneath the protective cover 63, thus leaving no protruding objects facing the rear seat of the vehicle which could be potentially harmful to a rear seat passenger in the event of an accident. The caregiver brake lever 21 is coupled to the actuating member 22 by means of a connecting wire 23. The connecting wire 23 is depicted as extending along the exterior surface of the seat, but is preferably integrated into the seat. A positive effect of this arrangement of the seat brake system 20 is that it contributes to a safe seat.

The actuating member 22 is arranged on the lower section of the seat and is rotatably connected to the same such that pressing the caregiver brake lever 21 will cause the actuating member to rotate.

The wheel frame brake system 30 is adapted to be provided on the wheel frame 102 of the wheelchair 100. The wheel frame brake system 30 comprises a brake transmission assembly 35 and a first 38 and a second 39 brake mechanism. The brake mechanisms are adapted to be provided on a first 40 and a second 41 wheel of the wheelchair respectively. The brake transmission assembly 35 is coupled to the first 38 and the second 39 brake mechanisms by means of connecting wires 24, 25 respectively. The brake mechanisms may comprise disc brakes. A disc brake is a type of brake that is adapted to provide an efficient brake force in response to a small stroke generated by some kind of brake activating member. However, other types of brake mechanisms with corresponding characteristics as disc brakes may represent equally plausible brake mechanisms.

The brake transmission assembly 35 is arranged at an upper side edge guide 13 of the wheel frame 102, as shown in FIGS. 1*a* and 1*b*, such that when the seat 101 is attached to the wheel frame 102 the actuating member 22 of the seat brake system 20 is within operable range of a first free end 32 comprised in the brake transmission assembly 35.

Figure 2A:
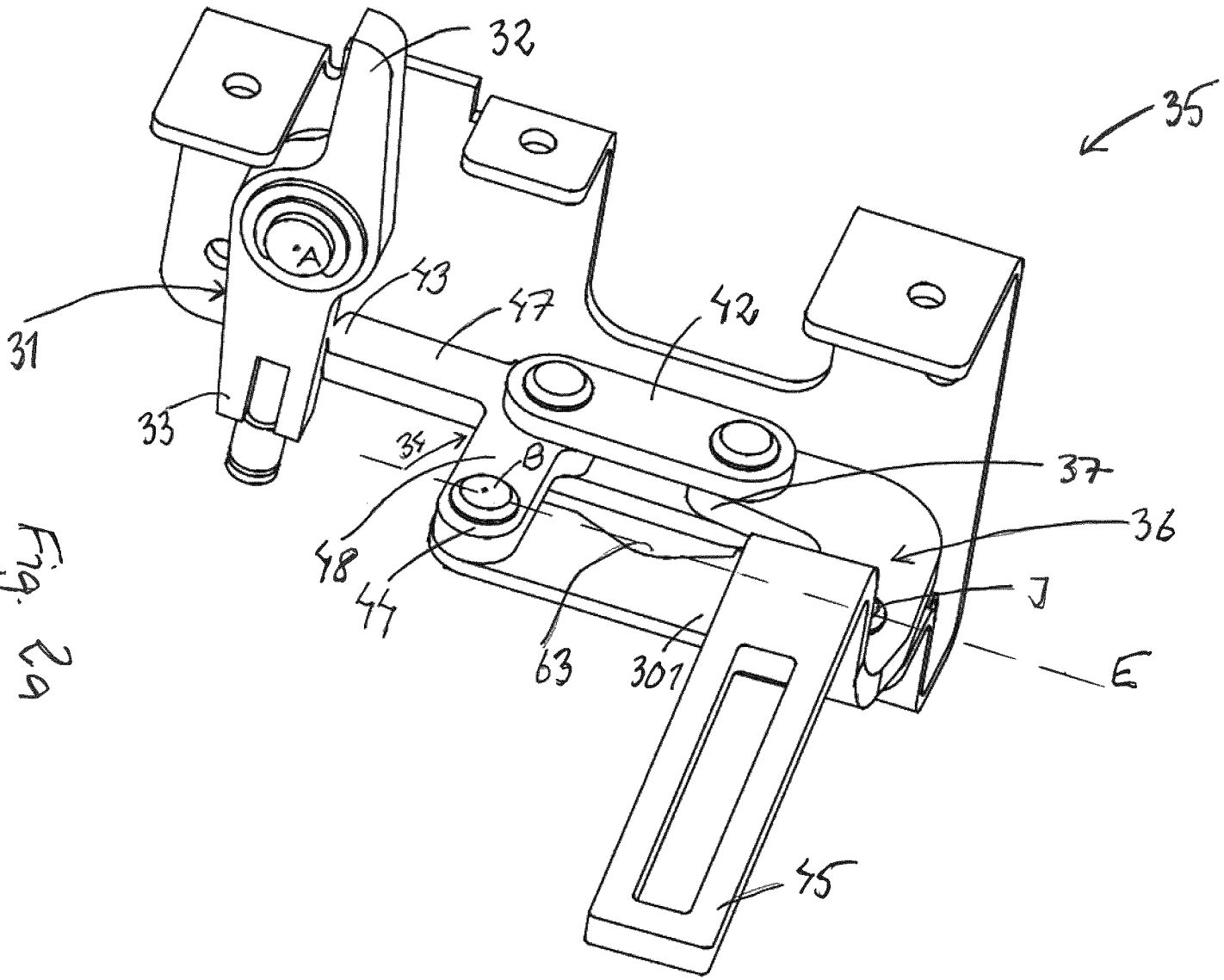
FIG. 2*a* shows a brake transmission assembly as disclosed herein and comprising a parking brake mechanism as disclosed herein in idle position.
Figure 2B:
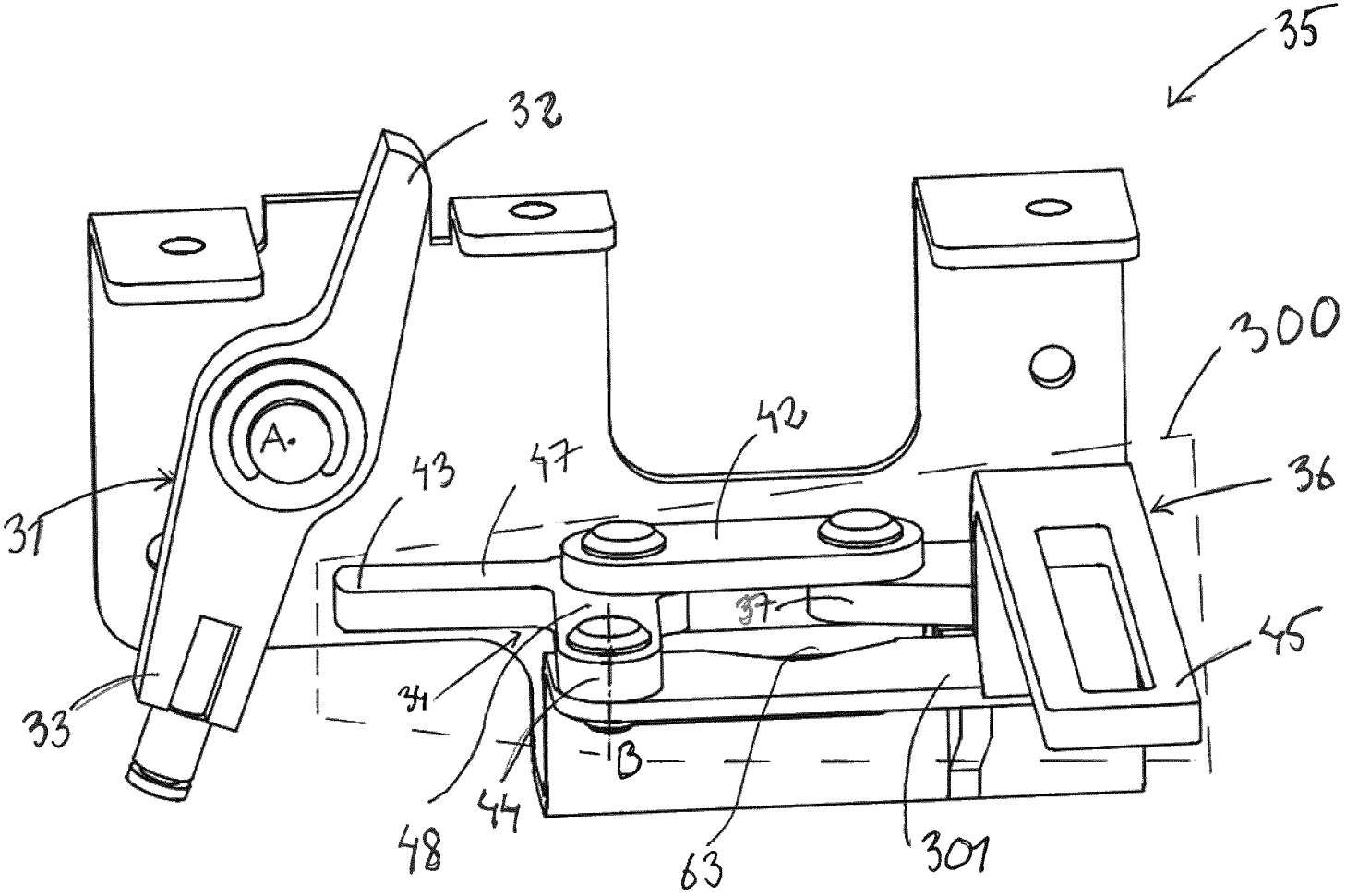
FIG. 2*b* shows a brake transmission assembly as disclosed herein and comprising a parking brake mechanism as disclosed herein in brake position.
Figure 2C:
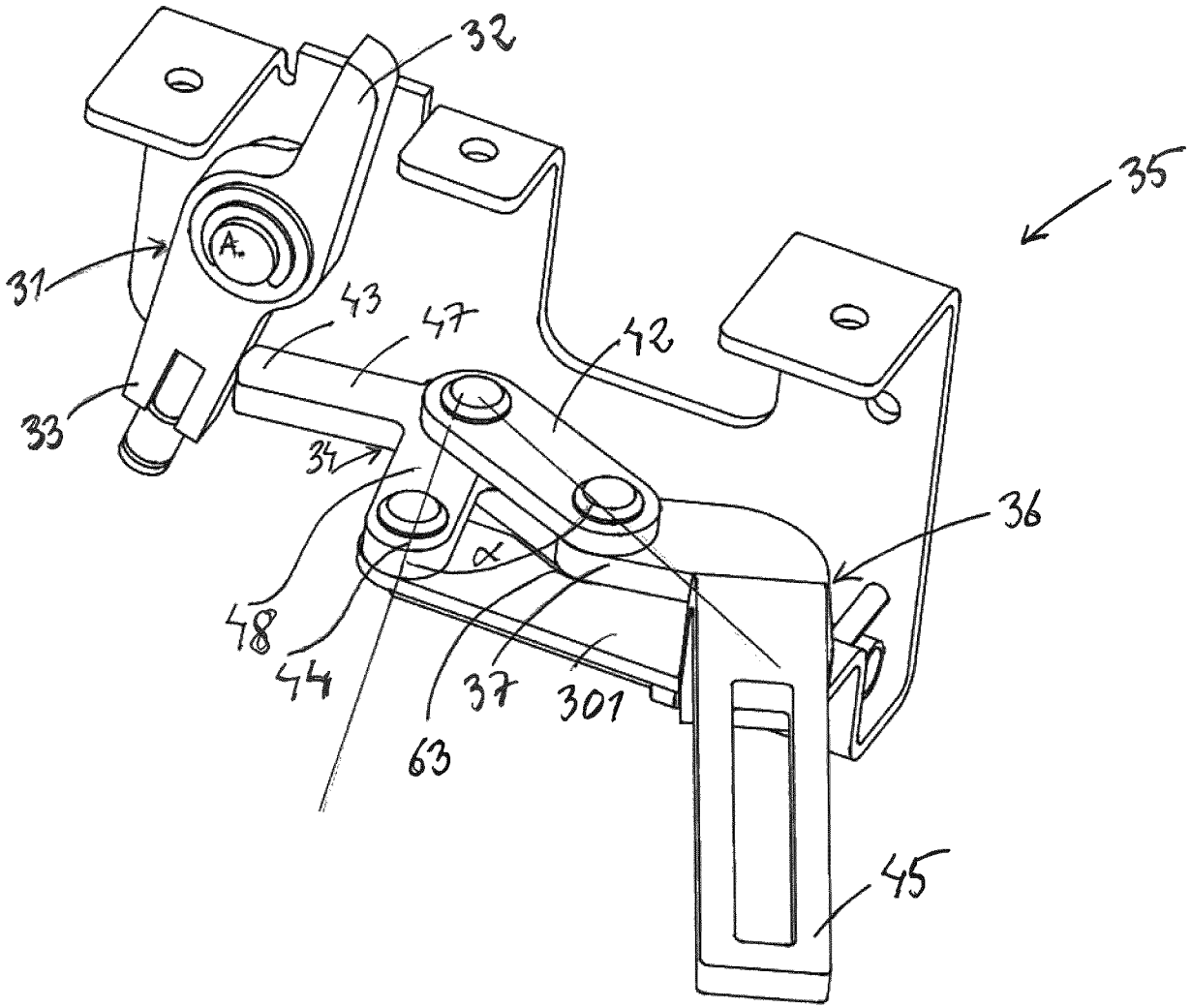
FIG. 2*c* shows a brake transmission assembly as disclosed herein and comprising a parking brake mechanism as disclosed herein in brake position.

With reference to FIGS. 2*a* to 2*c*, the brake transmission assembly 35 will be described in more detail. The brake transmission assembly 35 of the wheelchair brake assembly 10 as disclosed herein comprises an actuating lever 31 having a first free end 32 and a second end 33 couplable to the first 38 and the second 39 brake mechanisms. Further, the actuating lever 31 is rotatable about an axis A perpendicular to the longitudinal extension of the actuating lever 31 and located between the first free end 32 and the second end 33. The axis A may be located in a mid-portion of the actuating lever 31, such as halfway or substantially halfway between the first free end 32 and the second end 33. With the seat 101 attached to the wheel frame 102 an end portion 12 of the actuating member 22 (illustrated in FIG. 1*b*) and the first free end 32 of the actuating lever 31 are brought in close proximity of each other. In an idle position of the wheelchair brake assembly 10, that is no braking action is performed, the actuating lever 31 extends in a substantially vertical direction, as shown in FIG. 2*a*, and is not under influence of the actuating member 22. The actuating member 22 is however, as described previously in a position enabling it to operate on the first free end 32 of the actuating lever 31 to cause the second end 33 of the actuating lever 31 to rotate around the axis A, if a braking action is activated by pressing the caregiver brake lever 21. In a brake position of the wheelchair brake assembly 10, as shown in FIG. 2*b*, the actuating member 22 of the seat brake system 20 has been rotated (not illustrated in FIG. 2*b*), whereby the end portion 12 of the actuating member 22 has displaced the first free end 32 of the actuating lever 31 and thereby rotated the actuating lever 31. The rotation of the actuating lever 31 causes the wires 24, 25 connected between the brake mechanisms 38, 39 and the second end 33 of the actuating lever 31 to be tensioned since the connected second end 33 of the actuating lever 31 is displaced from its idle position. Tensioning the connecting wires 24, 25 will activate the brake mechanisms 38, 39. The activation of a brake mechanism of a kind applicable to the wheelchair brake assembly 10 as disclosed herein, by means of tensioning a wire connected to the brake mechanism, is well known to a person skilled in the art and will therefore not be explained in further detail herein.

A braking action being initiated by pressing the caregiver brake lever 21 will activate the brakes for as long as the caregiver brake lever 21 is pressed down. Releasing the hand force exerted on the caregiver brake lever 21 will reverse the interaction between the actuating member 22 and first free end 32 of the actuating member 31 which will return to its idle position.

An embodiment of a wheelchair brake assembly 10 as disclosed herein, may be provided with a second seat brake system 30 arranged on the seat 101 of the wheelchair 102, thus providing two caregiver brake levers 21, and wherein a second brake transmission assembly 35 may also be provided, wherein each brake transmission assembly 35 is coupled to a respective brake mechanism which is adapted to be provided at a wheel of the wheelchair 100.

The brake transmission assembly 35 as disclosed herein may comprise a parking brake mechanism 300. With reference to FIGS. 2*a* to 2*c* the parking brake mechanism 300 will be further explained. The parking brake mechanism 300 is adapted to influence the actuating lever 31 in the corresponding manner as the seat brake system 20 does, and thus activating the same brake mechanisms 38, 39. Hence, the same brake mechanisms 38, 39 are used both for the caregiver brake function and for the parking brake function. The parking brake mechanism 300 has an idle position and a brake position, as shown in FIGS. 2*a* and 2*c* respectively. As disclosed herein, the parking brake mechanism 300 is adapted to operate on the second end 33 of the actuating lever 31 to cause the actuating lever 31 to rotate around the axis A. This has the simultaneous effect of decoupling the first free end 32 of the actuating lever 31 from being operated on by the actuating member 22 of the seat brake system 20. Thus, pressing the caregiver brake lever 21 will not activate any braking action when the parking brake mechanism 300 is in the brake position. The parking brake mechanism 300 is adapted to achieve the same rotation of the actuating lever 31 as pressing the caregiver brake lever 21 is adapted to achieve, while at the same time decoupling the seat brake system 20 from operating on the brake transmission assembly 35 of the wheel brake system 30.

A parking brake mechanism 300 as disclosed herein comprises a rotatable brake lever 36 and a parking brake actuating member 34. The brake lever 36 is rotatably attached to a mounting plate 301 of the brake transmission assembly 35. The mounting plate 301 is adapted to be fixated to the wheel frame 102 of the wheelchair 100. Further, the brake lever 36 has a first end portion 45 and a second end portion 37. As disclosed in FIGS. 2*a* and 2*c*, the second end portion 37 and the first end portion 45 of the brake lever 36 extend substantially perpendicular to each other. The brake lever is rotatable around an axis J that is perpendicular to the longitudinal axes of the first 45 and second 37 end portions of the brake lever 36 and to the extension of the mounting plate 301. The first end portion 45 of the rotatable brake lever 36 comprises a handle intended to be gripped by hand and to be rotated. The parking brake actuating member 34 has a first leg 48 comprising a first end portion 44 and a second leg 47 comprising a second end portion 43. The first leg 48 and the second leg 47 of the parking brake actuating member 34 are substantially perpendicular to each other. The parking brake actuating member 34 is further rotatably attached to the other side of the mounting plate portion 301 and rotatable around an axis B perpendicular to the extension of the first leg 48 and located at the first end portion 44 of the first leg 48. The second end portion 43 of the parking brake actuating member 34 is adapted to operate on the second end 33 of the actuating lever 31. This is achieved by having the parking brake actuating member 34 connected to the brake lever 36 in such a way that rotating the first end portion 45 of the brake lever 36 causes the second end 43 of the parking brake actuating member 34 to operate on the second end 33 of the actuating member. For a wheelchair brake assembly 10 as disclosed herein, the parking brake actuating member 34 and the brake lever 36 may be directly or indirectly connected. The parking brake actuating member 34 and the brake lever 36 may be connected via a linkage system. For a wheelchair brake assembly 10 as disclosed herein, the parking brake actuating member 34 and the brake lever 36 may be connected via a linkage arm 42 comprised in the parking brake mechanism 300. This linkage system will be described in further detail with reference to FIGS. 2*a* to 2*c*. However, further configurations of linkage systems may be provided that operates to achieve the corresponding actions.

For a wheelchair brake assembly 10 as disclosed herein, the linkage arm 42 has a longitudinal extension with two opposing aligned end portions. The linkage arm 42 is further at one end rotatably connected to the second end portion 37 of the brake lever 36 and at the opposing end rotatably connected to the parking brake actuating member 34, at a position on the parking brake actuating member 34 such that when the parking brake mechanism 300 is in the idle position, the longitudinal axis of the linkage arm 42 is aligned with the longitudinal axis of second leg 47 of the parking brake actuating member 34 and thus perpendicular to the longitudinal axis of the first leg 48 of the parking brake actuating member 34. Furthermore, rotation of the first end 45 of the brake lever 36 to achieve the brake position, will cause the linkage arm 42 to rotate in relation to the parking brake actuating member 34 while at the same time cause the parking brake actuating member 34 to rotate and the second end 43 of the parking brake actuating member 34 to operate on the second end 33 of the actuating lever 31 to rotate the actuating lever 31. Thereby the connecting wire from the second end 33 of the actuating lever 31 to the brake mechanisms will be tensioned and thus the brake mechanisms will be activated. Hence, in the parking brake position, the linkage arm 42 forms an angle $\alpha$ less than 90° in relation to the first leg 48 of the parking brake actuating member 34. The configuration of the linkage system in this way has the advantageous effect of providing for an automatic locking of the parking brake mechanism 34 in the brake position.

The parking brake actuating member 34 and the brake lever 36 may be viewed as substantially L-shaped, being rotatable around separate points/axes B, J respectively, that are substantially aligned on a line E extending through both rotation points/axis. Furthermore, in the idle position of the parking brake mechanism 300, the configuration is such that the second leg 47 of the parking brake actuating member 34 and the second end portion 37 of the brake lever 36, and the linkage arm 42 all are aligned and substantially parallel to the line E (extending through the rotatable coupling points for the parking brake actuating member 34 and brake lever 36 to the mounting plate 301 respectively). The linkage arm 42 will transfer the rotation of the brake lever 36 to the parking brake actuating member 34 while at the same time rotating. Rotating the brake lever 36 such that the linkage arm 42 forms an angle α of less than 90° in relation to the first leg 48 of the parking brake actuating member 34 will activate the brake mechanisms and at the same time automatically lock or retain the configuration in this brake position. This may be most readily seen and understood by viewing the parking brake mechanism 300 starting from the activated brakes, as depicted in FIG. 2*c*, that is, in the brake position of the parking brake mechanism 300.

Imagining rotating the actuating lever 31 in opposite direction (to the brake rotation direction of the actuating lever 31), that is, attempting to deactivate the brakes by pressing back on the second end portion 43 of the second leg 47 of the parking brake actuating member 34, attempting to rotate the same, will actually cause the linkage arm 42 to rotate further in the opposite direction, that is further into a brake position, further decreasing the angle α between the linkage arm 42 and the first leg 48 of the parking brake actuating member 34, which in turn will lead to rotating the brake lever further in the braking direction. The automatic locking of the parking brake mechanism may only be released by rotating the first end portion of 45 of the brake lever 36 in an opposite direction from the brake position which means returning the first end portion 45 of the brake lever 36 to its idle position, such that the mechanism returns to the idle position.

For a wheelchair brake assembly 10 as disclosed herein, the parking brake mechanism 300 may be provided with a locking recess 63, which is provided for retaining the second end 37 of the brake lever 36 at a predetermined angle α, which is less than 90°, between the linkage arm 42 and the first leg 48 of the parking brake actuating member 34 in the brake position. In this way, the extent to which the parking brake actuating member 34 is enabled to rotate the actuating lever 31 of the brake transmission assembly 35, can be controlled and predetermined.

A wheelchair brake assembly 10 as disclosed herein may comprise a brake force distribution device 50. As shown in FIG. 1*a*, the brake force distribution device 50 is arranged in the wheel frame system 30 between the actuating lever 31 of the brake transmission assembly 35 and the first 38 and second 39 brake mechanisms in order to distribute the brake force. Thus, the brake force distribution device 50 is coupled at one end to the second end 33 of the actuating lever 31 by means of a connecting wire 26, and at an opposite end to the first 38 and second 39 brake mechanisms by means of a first 24 and second 25 connecting wire respectively.

A brake force distribution device 50 as disclosed herein, contributes to a simplified, less complicated wheelchair brake assembly 10, since it enables the use of a single caregiver brake lever 61 and a single brake transmission assembly 35 and further provides an efficient smooth braking of the wheelchair 100.

Figure 3A:
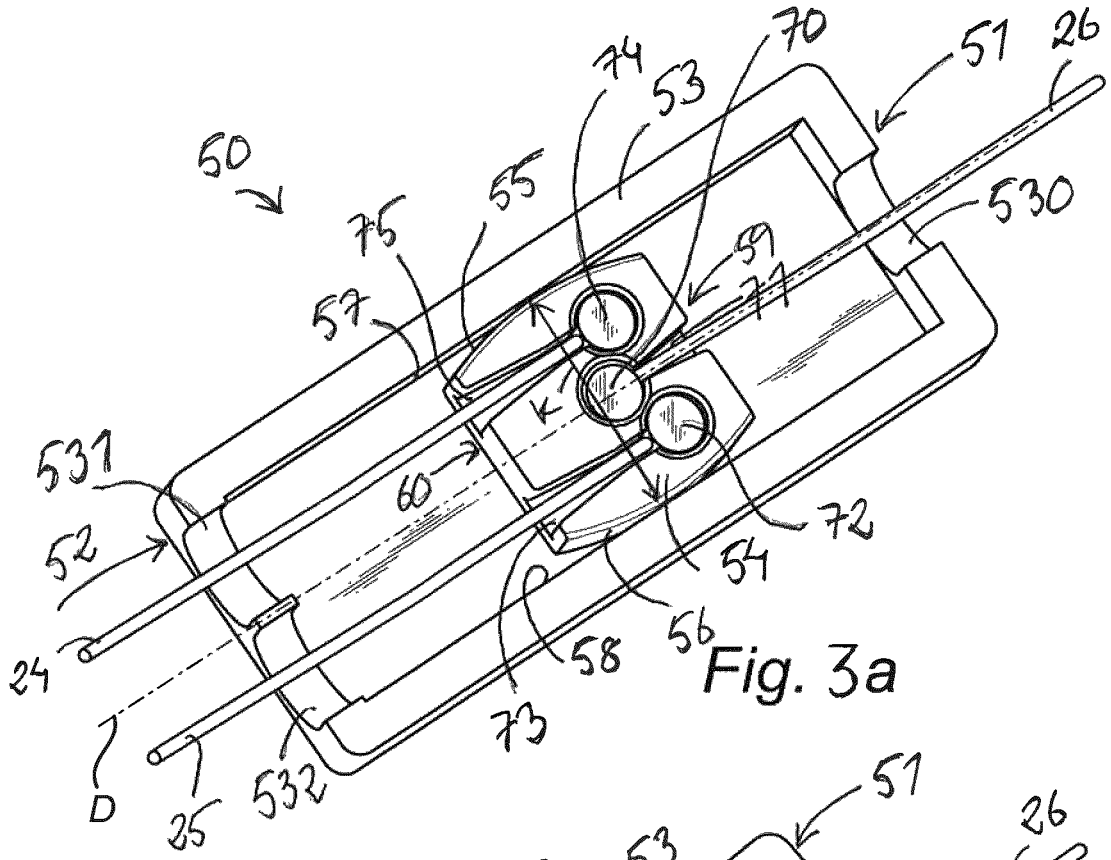
FIG. 3*a* shows a brake force distributor device as disclosed herein.
Figure 3B:
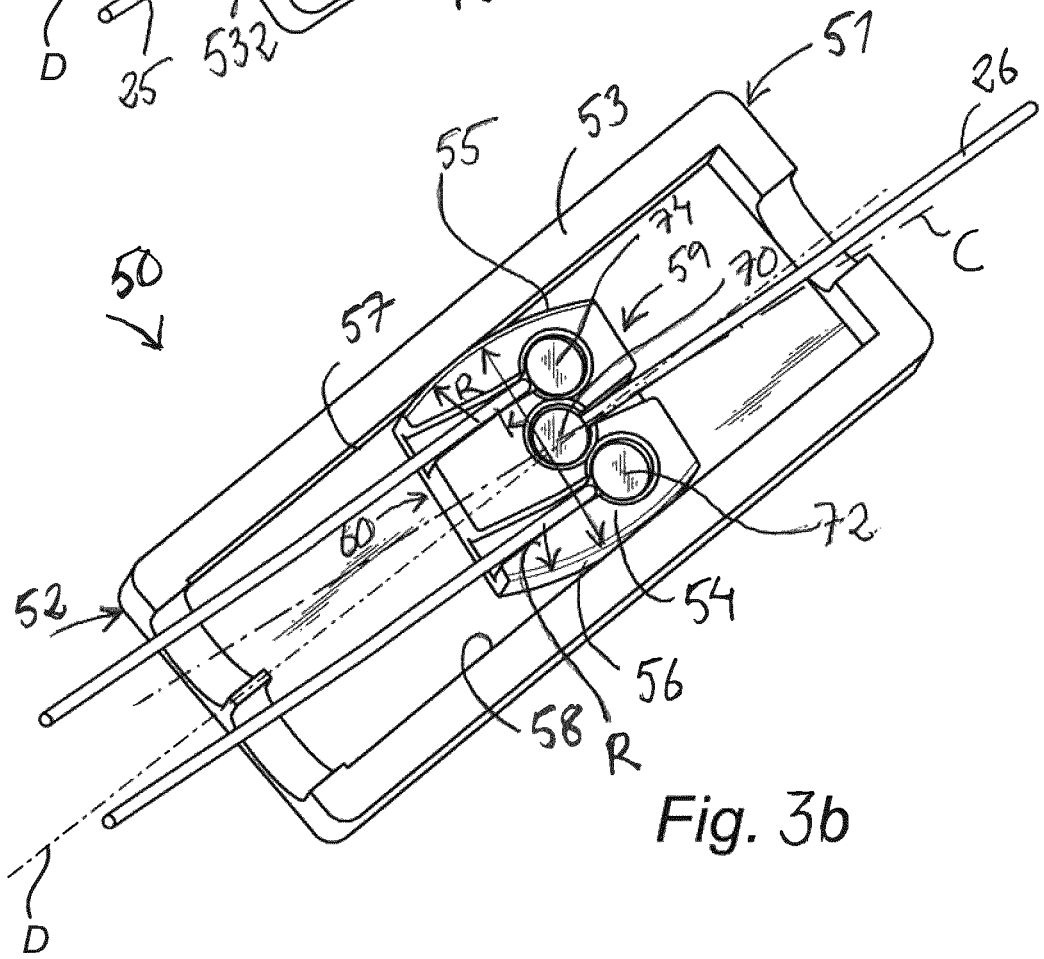
FIG. 3*b* shows a brake force distributor device as disclosed herein.

With reference to FIGS. 3*a* and 3*b*, a brake force distribution device 50 adapted to operate in a wheelchair brake assembly 10 as disclosed herein will be explained in further detail. However, a brake force distribution device 50 as disclosed herein is not thereby limited to the application of a wheelchair brake assembly 10 for a wheelchair 100 with a detachable seat 101. It is to be understood that the brake force distribution device 50 as disclosed herein may also be used in other applications. For example, it can be provided to improve brake systems for regular wheelchairs with non-detachable seats.

The brake force distribution device 50 comprises a housing 53 and a balance element 54. The balance element 54 is located within the housing 53. In FIGS. 3*a* and 3*b*, the housing 53 is depicted having a rectangular shape. The housing 53 may however have another shape and form. The housing 53 can alternatively have a substantially square shape for example. The housing comprises a first 57 and a second 58 inner wall which extend between the first end 51 and the second end 52 of the housing 53. The housing 53 is closed by attaching a cover to it, however in FIGS. 3*a* and 3*b* the housing 53 is depicted without the cover to enable viewing the balance element 54 inside. A first end 51 of the housing 53 comprises an aperture 530 intended as a passage for the connecting wire 26 from the actuating lever 31. Similarly, a second end 52 of the housing 53 comprises two apertures 531, 532 intended as passages for the connecting wires 24, 25 from the first 38 and the second 39 brake mechanisms respectively.

For the brake distribution device 50 as disclosed herein, the balance element 54 has a first end edge 59 facing the first end 51 of the housing 53 and a second end edge 60 facing the second end 52 of the housing 53. The balance element 54 further has a first 55 and a second 56 outer side edges extending at least partly between the first 59 and the second 60 end edges of the balance element 54. The first outer side edge 55 and the second outer side edge 56 of the balance element 54 has a convex shape. At least a section of the first 55 and second 56 outer side edges respectively are adapted to abut the first 57 and the second 58 inner walls of the housing 53, which enables the balance element 54 to be rotatably displaceable in relation to the longitudinal axis D of the housing 53.

A balance element 54 as disclosed herein has an extension k along a symmetry axis C of the balance element 54 which symmetry axis C extends between the first end edge 59 and the second end edge 60 of the balance element 54. The first outer side edge 55 and the second outer side edge 56 of the balance element 54 may have the shape of the minor arc of a circle with a radius R, the radius R being larger than a maximum of the extension k, such as between 1.1 and 4 times larger, between 1.1 and 2.5 times larger, or 1.2 and 2 times larger.

The connecting wires 26, 24, 25 from the actuating lever 31 and the first 38 and second 39 brake mechanisms respectively run through an individual aperture in the housing 53 as described above and are adapted to be attached to the balance element 54. The balance element 54 comprises wire attachment recesses 70, 72, 74 adapted to attach an end of a connecting wire. The wire attachment recess 70, 72, 74 merges into a wire passage 71, 73, 75 respectively, which wire passages 71, 73, 75 extends to either the first end edge 59 or the second end edge 60 of the balance element 54.

The connecting wire 26 from the second end 33 of the actuating lever 31 is attached to the first wire attachment recess 70 which is positioned centrally in the balance element 54 on or in close proximity of the symmetry axis C of the balance element 54 which extends between the first end edge 59 and the second end edge 60 of the balance element 54, such that the balance element 54 may be rotatably displaceable in relation to the longitudinal axis D of the housing 53 without substantially moving or displacing the wire attachment recess 70. The first wire attachment recess 70 merges into a first wire passage 71 extending to the first end edge 59 of the balance element 54. The connecting wires 24, 25 to the first 38 and second 39 brake mechanisms are attached at a second 72 and a third 74 wire attachment recesses respectively. The second 72 and third 74 wire attachment recesses may be located at a substantially equal distance from, and on opposite sides of the first wire attachment recess 70 respectively. The second 72 and third 74 wire attachment recesses merges into a second 73 and third 75 wire passage respectively, both of which extends to the second end edge 60 of the balance element 54.

The wire passages may have a tapered cross sectional shape, the wire passages being the narrowest at the corresponding wire attachment recess and being the widest at the end edge of the balance element 54. In this way the attached wire is allowed to move inside the wire passage without getting stuck or work against the rotational displacement of the balance element 54.

Hence, a brake force is transferred from the second end 33 of the actuating lever 31 via the connecting wire 26, which runs through the aperture 530 at the first end 51 of housing and the first wire passage 71 and ends in the wire attachment recess 70, to the balance element 54, which distributes the brake force to the connecting wires 24, 25 that runs from the second 72 and third 74 wire attachment recesses respectively, through the second 73 and third 75 wire passages respectively, and through a respective aperture 531, 532 at the second end 52 of the housing 53 to the first 38 and second 39 brake mechanisms respectively. Since the balance element 54 is rotatably displaceable to the longitudinal axis D of the housing 53, depending on the resistance in the connecting wires from the brake mechanisms respectively, the braking force will be distributed to achieve a smooth braking.

The balance element 54 may be made in a polymeric material, such as a thermoplastic. One example of a thermoplastic material may be polyamide. Other useful materials may be composites of polymers and reinforcing materials, e.g. fibers or particles, for example polyamide comprising glass fibres. The balance element 54 may be made of a metallic material, such as zinc.

Using a polymeric material such as polyamide for the balance element 54 provides a light-weight, yet tough and resistant balance brake element 54. Further it provides for easy manufacturing and low manufacturing costs as thermoplastic polymers can be formed into a desired shape by production methods such as 3D-printing and injection moulding.

The invention claimed is:

1. A wheelchair brake assembly comprising a seat brake system and a wheel frame brake system, said seat brake system and said wheel frame brake system being separable from each other, said seat brake system comprising a caregiver brake lever and an actuating member, said caregiver brake lever being coupled to said actuating member, said wheel frame brake system comprising a brake transmission assembly, a first brake mechanism and a second brake mechanism which are adapted to be provided on a first wheel and a second wheel of said wheelchair respectively, said brake transmission assembly being coupled to said first brake mechanism and said second brake mechanism, characterized in that said brake transmission assembly comprises an actuating lever having a first free end and a second end, said second end being coupled to said first brake mechanism and said second brake mechanism, said actuating lever being rotatable about a first axis perpendicular to the longitudinal extension of said actuating lever and located between said first free end and said second end of said actuating lever, wherein said actuating member of said seat brake system is adapted to operate on said first free end of said actuating lever to cause said actuating lever to rotate.

2. A wheelchair brake assembly according to claim 1, wherein said brake transmission assembly comprises a parking brake mechanism, said parking brake mechanism having an idle position and a brake position, wherein said parking brake mechanism in said brake position is adapted to operate on said second end of said actuating lever to cause said second end of said actuating lever to rotate and simultaneously decouple said first free end of said actuating lever from being operative by said actuating member.

3. A wheelchair brake assembly according to claim 2, characterized in that said parking brake mechanism comprises a rotatable brake lever having a first end portion and a second end portion, and a parking brake actuating member having a first end portion and a second end portion, said second end portion of said parking brake actuating member being adapted to operate on said second end of said actuating lever by means of a rotation of said brake lever, wherein said parking brake actuating member is connected directly or indirectly to said brake lever.

4. A wheelchair brake assembly according to claim 3, wherein said parking brake actuating member is connected via a linkage system to said brake lever.

5. A wheelchair brake system according to claim 3, characterized in that said parking brake mechanism comprises a linkage arm, said parking brake actuating member having a first leg comprising said first end portion of said parking brake actuating member and a second leg comprising said second end portion of said parking brake actuating member, said first leg and said second leg of said parking brake actuating member being substantially perpendicular to each other, said parking brake actuating member being rotatable around a second axis located at said first end portion, said linkage arm being at one end rotatably connected to said second end portion of said brake lever and at the other end rotatably connected to said parking brake actuating member, such that rotating said first end portion of said brake lever causes said parking brake actuating member to rotate and thereby causing said second end portion of said parking brake actuating member to operate on said second end of said actuating lever to cause said actuating lever to rotate.

6. A wheelchair brake assembly according to claim 5, characterized in that in said idle position of said parking brake mechanism, said linkage arm is substantially perpendicular to said first leg of said parking brake actuating member, and wherein said linkage arm is rotatable to form an angle of less than 90° in relation to said first leg of said parking brake actuating member in said brake position of said parking brake mechanism.

7. A wheelchair brake assembly according to claim 5, characterized in that said parking brake mechanism is provided with a locking recess adapted to retain said second end portion of said brake lever, in said brake position of said parking brake mechanism, at said angle of less than 90° between said linkage arm and said first leg of said parking brake actuating member.

8. A wheelchair brake assembly according claim 1, characterized in that said wheel frame brake system comprises a brake force distribution device, said brake force distribution device being couplable at one end to said second end of said actuating member and at an opposite end to said first brake mechanism and said second brake mechanism and being adapted to distribute a brake force transmitted from said brake transmission assembly to said first brake mechanism and said second brake mechanism.

9. A wheelchair brake assembly according to claim 8, characterized in that said brake force distribution device comprises a housing and a balance element, said balance element being located within said housing, said balance element having a first end edge facing a first end of said housing and having a second end edge facing a second end of said housing, said balance element further having a first outer side edge and a second outer side edge extending at least partly between said first end edge and said second end edge of said balance element, wherein said first outer side edge and said second outer side edge have a convex shape, and wherein at least a section of said first outer side edge and at least a section of said second outer side edge respectively is adapted to abut a first inner wall and a second inner wall of said housing respectively, and wherein said balance element is rotatably displaceable in relation to a longitudinal axis of said housing.

10. A wheel chair brake assembly according to claim 9, wherein said balance element has an extension along a symmetry axis of said balance element which symmetry axis extends between said first end edge and said second end edge of said balance element, and wherein said first outer side edge and said second outer side edge of said balance element have the shape of the minor arc of a circle with a radius, said radius being larger than a maximum of said extension.

11. A wheelchair brake assembly according to claim 1, characterized in that said first brake mechanism and said second brake mechanism comprise disc brakes.

12. A wheelchair comprising a wheelchair brake assembly according to claim 1.

13. A wheelchair according to claim 12, further comprising a handle arranged at the back of a seat of said wheelchair, said caregiver brake lever being arranged together with said handle, said caregiver brake lever and said handle being adapted to be retractable in a back pocket comprised in said seat of said wheelchair.

* * * * *